US011754978B2

(12) United States Patent
Hasei et al.

(10) Patent No.: US 11,754,978 B2
(45) Date of Patent: Sep. 12, 2023

(54) METHOD FOR MANUFACTURING WATCH COMPONENT

(71) Applicant: Seiko Epson Corporation, Toyko (JP)

(72) Inventors: Hironori Hasei, Azumino (JP); Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 156 days.

(21) Appl. No.: 17/194,471

(22) Filed: Mar. 8, 2021

(65) Prior Publication Data

US 2021/0278807 A1 Sep. 9, 2021

(30) Foreign Application Priority Data

Mar. 9, 2020 (JP) ..... 2020-039607

(51) Int. Cl.
*G04D 3/00* (2006.01)
*G04B 37/22* (2006.01)

(52) U.S. Cl.
CPC ..... *G04D 3/0074* (2013.01); *G04B 37/22* (2013.01); *G04D 3/0002* (2013.01)

(58) Field of Classification Search
CPC .... G04D 3/0074; G04D 3/0002; G04B 37/22; C23C 8/02; C23C 8/26; C23C 8/36; C23C 8/48; C21D 1/74; C21D 6/002; C21D 9/0068; C21D 3/08; C21D 6/00; C21D 2211/001; C21D 2211/005; C22C 38/001; C22C 38/02; C22C 38/04; C22C 38/06; C22C 38/18; C22C 38/20; C22C 38/22; C22C 38/26; C22C 38/00; C22C 38/42; C22C 38/44; C22C 38/48
See application file for complete search history.

(56) References Cited

U.S. PATENT DOCUMENTS

| | | | | |
|---|---|---|---|---|
| 8,303,168 | B2 | 11/2012 | Takasawa | |
| 2007/0217293 | A1 | 9/2007 | Takasawa | |
| 2009/0073815 | A1 | 3/2009 | Takasawa | |
| 2021/0072704 | A1 | 3/2021 | Kobayashi | |
| 2021/0181683 | A1* | 6/2021 | Takasawa | C22C 38/001 |

FOREIGN PATENT DOCUMENTS

| | | | |
|---|---|---|---|
| CN | 105039899 | A | 11/2015 |
| JP | 2007-247035 | A | 9/2007 |
| JP | 2007-248397 | A | 9/2007 |
| JP | 2009-069049 | A | 4/2009 |
| JP | 2013-101157 | A | 5/2013 |
| JP | 2021-042968 | A | 3/2021 |

OTHER PUBLICATIONS rolexforums.com/showthread.php?t=46328 (Year: 2008).*

* cited by examiner

*Primary Examiner* — Moshe Wilensky
(74) *Attorney, Agent, or Firm* — Harness, Dickey & Pierce, P.L.C.

(57) ABSTRACT

A method for manufacturing a watch component is a method for manufacturing a watch component that is formed of an austenitized ferritic stainless steel including a base portion formed by a ferrite phase and a surface layer formed by an austenitized phase obtained by austenitizing the ferrite phase. The method includes a first processing step for forming a thinned portion by providing a step in a base material formed of a ferritic stainless steel, a heat treatment step for performing nitrogen absorption treatment on the base material to form the surface layer on an outer surface side of the base portion, and a second processing step for providing a hole portion in the thinned portion.

20 Claims, 10 Drawing Sheets

METHOD FOR MANUFACTURING WATCH COMPONENT

The present application is based on, and claims priority from JP Application Serial Number 2020-039607, filed Mar. 9, 2020, the disclosure of which is hereby incorporated by reference herein in its entirety.

BACKGROUND

1. Technical Field

The present disclosure relates to a method for manufacturing a watch component.

2. Related Art

In JP-A-2013-101157, a watch housing, more specifically, a case body and a case back are disclosed that are formed of a ferritic stainless steel, a surface layer of which is austenitized by nitrogen absorption treatment.

In JP-A-2013-101157, the surface layer of the ferritic stainless steel is austenitized so as to obtain the hardness, corrosion resistance, and anti-magnetic performance required for the watch housing.

In the watch housing described in JP-A-2013-101157, when a hole portion for disposing a button or a crown is formed, an internal ferrite phase is exposed. Thus, there is a problem in that the corrosion resistance may deteriorate in the hole portion.

SUMMARY

A method for manufacturing a watch component according to the present disclosure is a method for manufacturing a watch component that is including an austenitized ferritic stainless steel including a base portion formed by a ferrite phase and a surface layer formed by an austenitized phase obtained by austenitizing the ferrite phase, and the method includes a first processing step for forming a thinned portion by providing a step in a base material formed by a ferritic stainless steel, a heat treatment step for performing nitrogen absorption treatment on the base material to form the surface layer on an outer surface side of the base portion, and a second processing step for providing a hole portion in the thinned portion.

DESCRIPTION OF EXEMPLARY EMBODIMENTS

Embodiments

A watch 1 according to an embodiment of the present disclosure will be described below with reference to the drawings.

Figure 1:
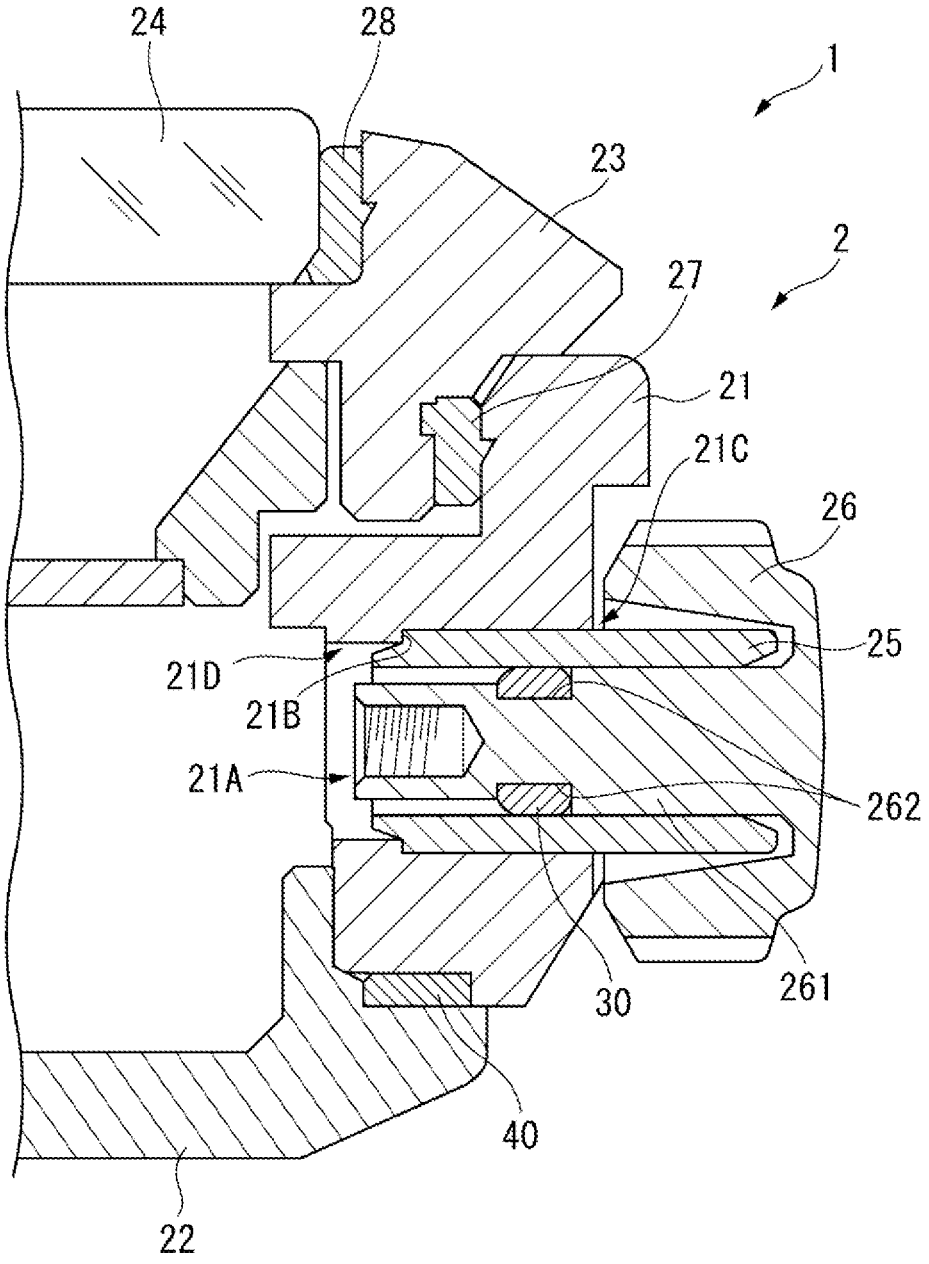
FIG. 1 is a partial cross-sectional view illustrating an outline of a watch according to an embodiment.

FIG. 1 is a partial cross-sectional view illustrating an outline of the watch 1 according to this embodiment.

As illustrated in FIG. 1, the watch 1 includes an outer case 2. The outer case 2 includes a cylindrical case main body 21, a case back 22 fixed to a back surface side of the case main body 21, an annular bezel 23 fixed to an outer surface side of the case main body 21, and a glass plate 24 held by the bezel 23. Further, a movement (not illustrated) is housed in the case main body 21. Note that the case main body 21 is an example of a watch component of the present disclosure.

A through hole 21A is provided in the case main body 21. Here, in this embodiment, a step 21B is provided in the inner circumferential surface of the through hole 21A of the case main body 21, and the through hole 21A is configured by a large diameter portion 21C and a small diameter portion 21D, which are formed with the step 21B interposed therebetween. Then, a winding stem pipe 25 is fitted into and fixed to the large diameter portion 21C of the through hole 21A.

A shaft portion 261 of a crown 26 is rotatably inserted into the winding stem pipe 25.

The case main body 21 and the bezel 23 are engaged with each other via a plastic packing 27, and the bezel 23 and the glass plate 24 are fixed to each other by a plastic packing 28.

Further, the case back 22 is fitted with or screwed into the case main body 21. Then, between the case main body 21 and the case back 22, a ring-shaped rubber packing or a case back packing 40 is inserted in a compressed state. With this configuration, a space between the case main body 21 and the case back 22 is sealed so as to be liquid-tight, and a waterproof function is obtained.

A groove 262 is formed partway along the outer circumference of the shaft portion 261 of the crown 26, and a ring-shaped rubber packing 30 is fitted into this groove 262. The rubber packing 30 adheres to the inner circumferential surface of the winding stem pipe 25 and is compressed between the inner circumferential surface and the inner surface of the groove 262. With this configuration, a space between the crown 26 and the winding stem pipe 25 is sealed so as to be liquid-tight, and the waterproof function is obtained. Note that when the crown 26 is rotated to be operated, the rubber packing 30 rotates together with the shaft portion 261 and slides in the circumferential direction while adhering to the inner circumferential surface of the winding stem pipe 25.

Case Main Body

Figure 2:
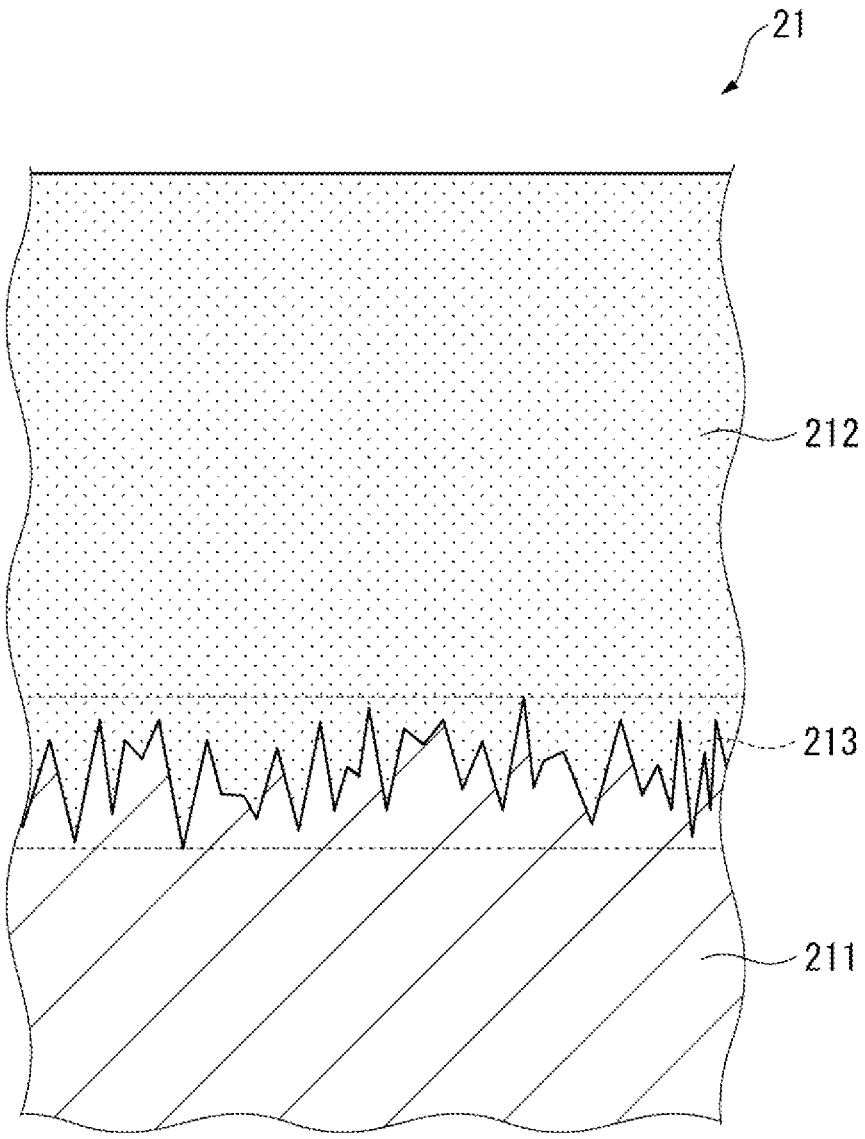
FIG. 2 is a cross-sectional view illustrating main portions of a case main body.

FIG. 2 is a cross-sectional view illustrating main portions of the case main body 21, more specifically, a predetermined area from the outer surface of the case main body 21.

As illustrated in FIG. 2, the case main body 21 is configured by a ferritic stainless steel including a base portion 211 formed by a ferrite phase, a surface layer 212 formed by an austenite phase (hereinafter referred to as an austenitized phase) obtained as a result of the ferrite phase being austenitized, and a mixed layer 213 in which the ferrite phase and the austenitized phase are mixed.

Base Portion

The base portion 211 is formed of the ferritic stainless steel that contains, in mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with the remaining portion including Fe and unavoidable impurities.

Cr is an element that increases a transfer velocity of nitrogen to the ferrite phase and a diffusion velocity of nitrogen in the ferrite phase in nitrogen absorption treatment. If Cr is less than 18%, the transfer velocity and the diffusion velocity of nitrogen are reduced. Further, if Cr is less than 18%, corrosion resistance of the surface layer 212 is reduced. On the other hand, if Cr exceeds 22%, Cr is hardened and processability as a material deteriorates. Further, if Cr exceeds 22%, the aesthetic appearance is impaired. Therefore, the Cr content is preferably from 18 to 22%, more preferably, from 20 to 22%, and even more preferably from 19.5 to 20.5%.

Mo is an element that increases the transfer velocity of nitrogen to the ferrite phase and the diffusion velocity of nitrogen in the ferrite phase in the nitrogen absorption treatment. If Mo is less than 1.3%, the transfer velocity and the diffusion velocity of nitrogen are reduced. Further, if Mo is less than 1.3%, the corrosion resistance as a material deteriorates. On the other hand, if Mo exceeds 2.8%, Mo is hardened and the processability as a material deteriorates. Further, if Mo exceeds 2.8%, the structural composition of the surface layer 212 becomes notably heterogeneous, and the aesthetic appearance is impaired. Therefore, the Mo content is preferably from 1.3 to 2.8%, more preferably from 1.8 to 2.8%, and even more preferably from 2.25 to 2.35%.

Nb is an element that increases the transfer velocity of nitrogen to the ferrite phase and the diffusion velocity of nitrogen in the ferrite phase in the nitrogen absorption treatment. If Nb is less than 0.05%, the transfer velocity and the diffusion velocity of nitrogen are reduced. On the other hand, if Nb exceeds 0.05%, Nb is hardened and the processability as a material deteriorates. Further, a deposited portion is generated, and the aesthetic appearance is impaired. Therefore, the Nb content is preferably from 0.05 to 0.5%, more preferably from 0.05 to 0.3%, and even more preferably from 0.15 to 0.25%.

Cu is an element that controls absorption of nitrogen in the ferrite phase in the nitrogen absorption treatment. If Cu is less than 0.1%, variation in the nitrogen content in the ferrite phase increases. On the other hand, if Cu exceeds 0.8%, the transfer velocity of nitrogen to the ferrite phase is reduced. Therefore, the Cu content is preferably from 0.1 to 0.8%, more preferably from 0.1 to 0.2%, and even more preferably from 0.1 to 0.15%.

Ni is an element that inhibits the transfer of nitrogen to the ferrite phase and the diffusion of nitrogen in the ferrite phase in the nitrogen absorption treatment. If Ni is 0.5% or greater, the transfer velocity and the diffusion velocity of nitrogen are reduced. Further, the corrosion resistance deteriorates, and there is a possibility that it may become more difficult to prevent an occurrence of a metal allergy and the like. Therefore, the Ni content is preferably less than 0.5%, more preferably less than 0.2%, and even more preferably less than 0.1%.

Mn is an element that inhibits the transfer of nitrogen to the ferrite phase and the diffusion of nitrogen in the ferrite phase in the nitrogen absorption treatment. If Mn is 0.8% or greater, the transfer velocity and the diffusion velocity of nitrogen are reduced. Therefore, the Mn content is preferably less than 0.8%, more preferably less than 0.5%, and even more preferably less than 0.1%.

Si is an element that inhibits the transfer of nitrogen to the ferrite phase and the diffusion of nitrogen in the ferrite phase in the nitrogen absorption treatment. If Si is 0.5% or greater, the transfer velocity and the diffusion velocity of nitrogen are reduced. Therefore, the Si content is preferably less than 0.5% and more preferably less than 0.3%.

P is an element that inhibits the transfer of nitrogen to the ferrite phase and the diffusion of nitrogen in the ferrite phase in the nitrogen absorption treatment. If P is 0.10% or greater, the transfer velocity and the diffusion velocity of nitrogen are reduced. Therefore, the P content is preferably less than 0.10%, and more preferably less than 0.03%.

S is an element that inhibits the transfer of nitrogen to the ferrite phase and the diffusion of nitrogen in the ferrite phase in the nitrogen absorption treatment. If S is 0.05% or greater, the transfer velocity and the diffusion velocity of nitrogen are reduced. Therefore, the S content is preferably less than 0.05%, and more preferably less than 0.01%.

N is an element that inhibits the transfer of nitrogen to the ferrite phase and the diffusion of nitrogen in the ferrite phase in the nitrogen absorption treatment. If N is 0.05% or greater, the transfer velocity and the diffusion velocity of nitrogen are reduced. Therefore, the N content is preferably less than 0.05%, and more preferably less than 0.01%.

C is an element that inhibits the transfer of nitrogen to the ferrite phase and the diffusion of nitrogen in the ferrite phase in the nitrogen absorption treatment. If C is 0.05% or greater, the transfer velocity and the diffusion velocity of nitrogen are reduced. Therefore, the C content is preferably less than 0.05%, and more preferably less than 0.02%.

Note that the base portion 211 is not limited to the configuration described above, and it is sufficient that the base portion be formed by the ferrite phase.

Surface Layer

The surface layer 212 is provided as a result of performing the nitrogen absorption treatment on the base material formed of a ferritic stainless steel, and the ferrite phase of the base material being austenitized. In this embodiment, the content of nitrogen in the surface layer 212 is 1.0 to 1.6% in mass %. In other words, nitrogen is contained in the surface layer 212 at a high concentration. As a result, the corrosion resistance performance of the surface layer 212 can be improved.

Mixed Layer

In the course of forming the surface layer 212, the mixed layer 213 is formed due to the variation in the transfer velocity of nitrogen entering the base 211 portion formed by the ferrite phase. In other words, at locations at which the transfer velocity is fast, nitrogen deeply enters the ferrite phase and austenitizes the ferrite phase up to a deep section of each of the locations, but at locations at which the transfer velocity is slow, nitrogen austenitizes the ferrite phase only up to a shallow section of each of the locations. As a result, the mixed layer 213 is formed in which the ferrite phase and the austenitized phase are mixed with respect to the depth direction. Note that the mixed layer 213 is a layer including a shallowest section to a deepest section of the austenitized phase in a cross-sectional view, and is a layer thinner than the surface layer 212.

Method for Manufacturing Case Main Body

Next, a method for manufacturing the case main body 21 will be described.

FIG. 3 to FIG. 6 are schematic views illustrating a manufacturing process of the case main body 21. Note that in each of FIG. 3 to FIG. 7, a cross section of the case main body 21 is illustrated. Further, in FIG. 5 to FIG. 7, the thickness of the surface layer 212 is illustrated in an exaggerated manner in order to make it easier to understand the layer configuration. Furthermore, in FIG. 5 to FIG. 7, the mixed layer 213 formed between the base portion 211 and the surface layer 212 is omitted for easier understanding.

First Processing Step

Figure 3:
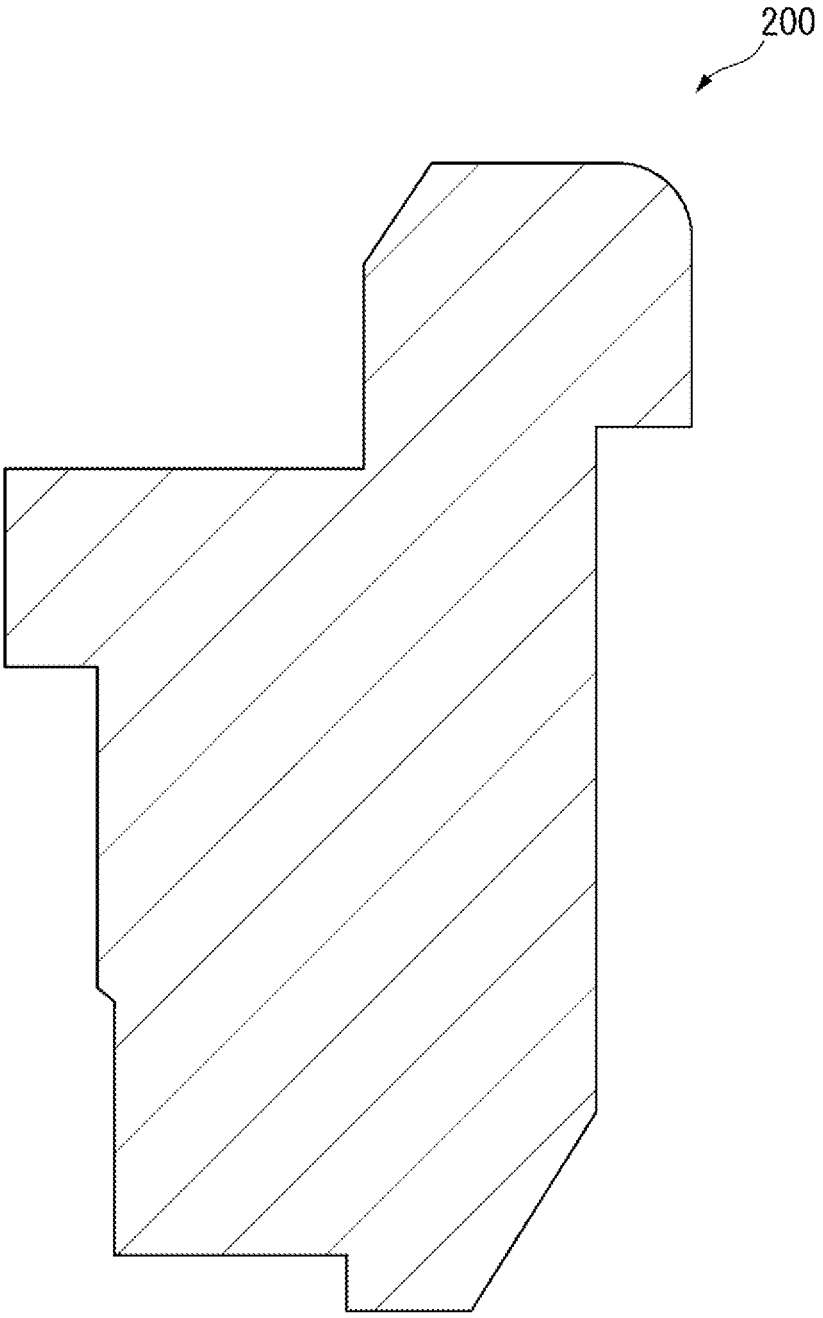
FIG. 3 is a schematic view illustrating a manufacturing process of the case main body.

First, as a first processing step, as illustrated in FIG. 3, by performing processing, such as cutting, forging, casting, powder forming, or the like, on a ferritic stainless steel, a base material 200 made of the ferritic stainless steel is formed.

Figure 4:
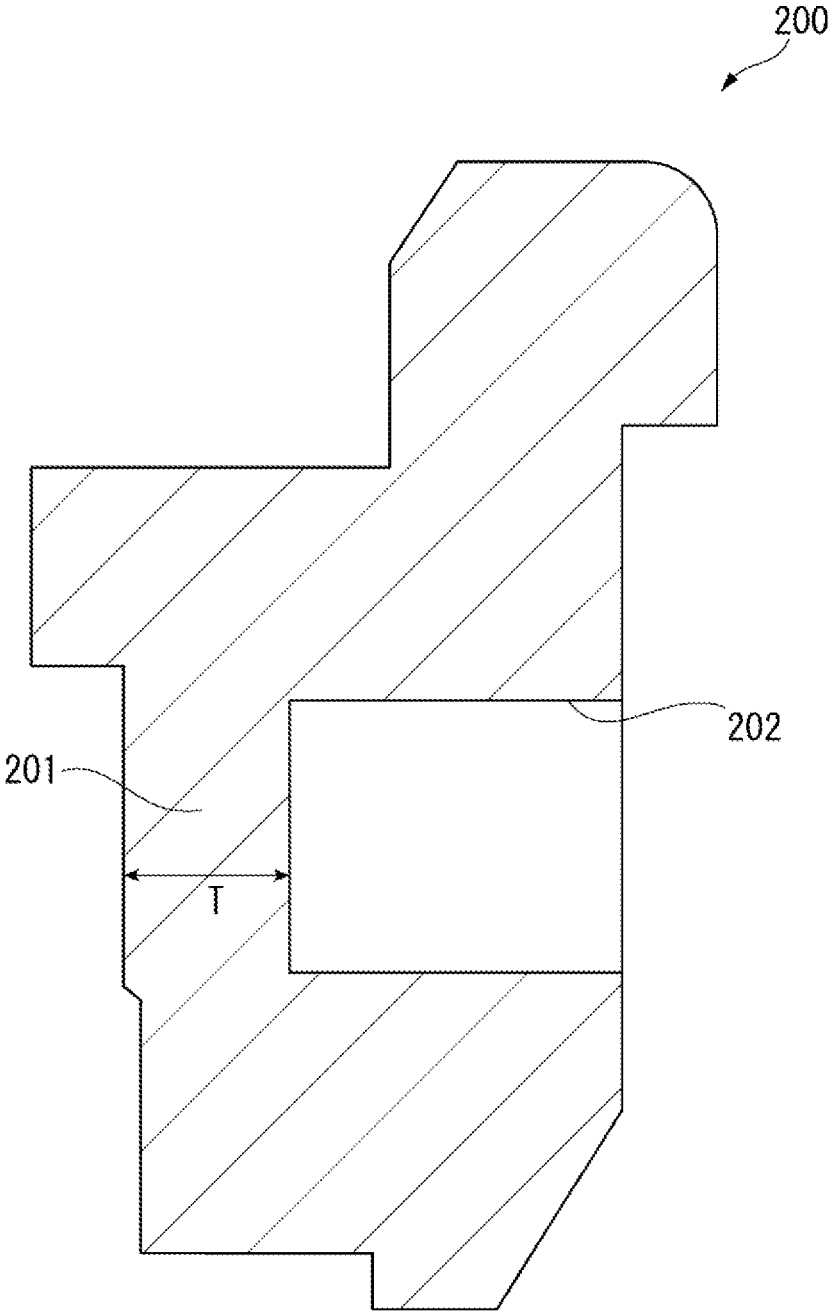
FIG. 4 is a schematic view illustrating the manufacturing process of the case main body.

Next, as illustrated in FIG. 4, by providing a step in the base material 200 by cutting a position corresponding to the through hole 21A, a thinned portion 201 is formed. In this embodiment, a recessed portion 202 is formed on an outer surface side of the base material 200 by cutting, in the thickness direction, the base material 200 from the outer surface side thereof, that is, a side of the base material 200 that is exposed when assembled as the watch 1. As a result, the thinned portion 201 is formed on an inner surface side of the base material 200. Note that the first processing step is a so-called rough processing step.

Here, in this embodiment, the recessed portion 202 is formed by cutting so that a thickness T of the thinned portion 201 is from 0.5 mm to 3.0 mm and preferably from 0.5 mm to 2.0 mm.

Heat Treatment Step

Figure 5:
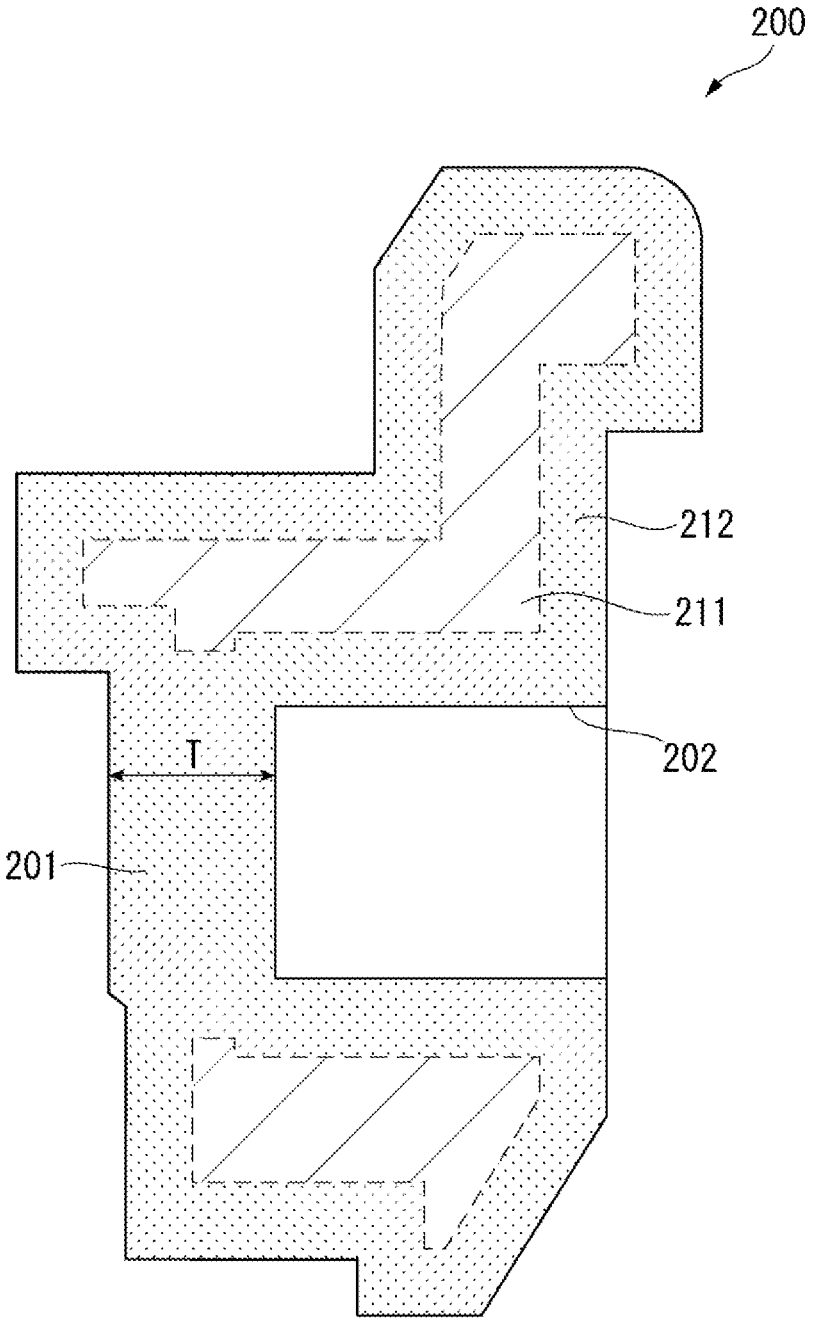
FIG. 5 is a schematic view illustrating the manufacturing process of the case main body.

Next, as a heat treatment step, as illustrated in FIG. 5, the nitrogen absorption treatment is performed on the base material 200 that has been processed as described above. As a result, nitrogen enters the base material 200 from the outer surface thereof, and the surface layer 212 in which the ferrite phase has been austenitized is formed on an outer surface side of the base portion 211. In other words, in the heat treatment step, the surface layer 212 is formed using nitrogen in a solid solution state.

At this time, in this embodiment, the nitrogen absorption treatment is performed on the base material 200 so that the nitrogen content of the surface layer 212 is from 1.0 to 1.6% in mass %. Further, in this embodiment, the nitrogen absorption treatment is performed on the base material 200 so that the thinned portion 201 is austenitized across all layers thereof in the thickness direction. Furthermore, in this embodiment, a treatment time and a temperature of the nitrogen absorption treatment are controlled so that the base portion 211 formed by the ferrite phase remains in a portion other than the thinned portion 201. In other words, the nitrogen absorption treatment is performed so that nitrogen enters all the layers of the thinned portion 201 that has been subjected to the thinning process, and in the portion other than the thinned portion 201, the ferrite phase in which nitrogen has not entered remains.

Here, as described above, since the thinned portion 201 is formed so that the thickness T is 3.0 mm or less, it is possible to prevent the treatment time of the nitrogen absorption treatment, which is required to austenitize all the layers of the thinned portion 201, from being prolonged. Furthermore, if the thinned portion 201 is formed so that the thickness T is 2.0 mm or less, even when the base material 200 is formed so that the base portion 211 formed by the ferrite phase remains in the portion other than the thinned portion 201, it is not necessary to increase the thickness of the base material 200 more than necessary, and the watch 1 can thus be made thinner.

Second Processing Step

Figure 6:
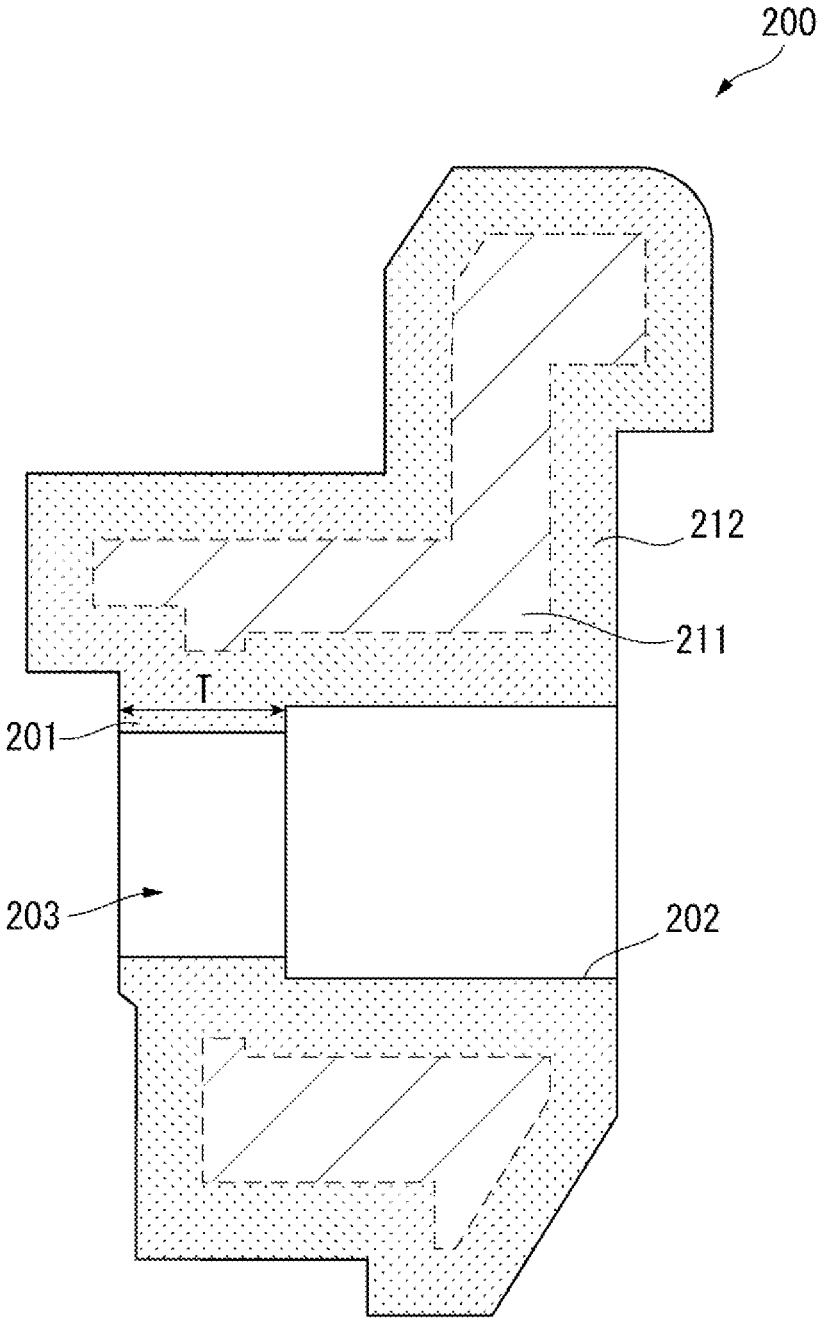
FIG. 6 is a schematic view illustrating the manufacturing process of the case main body.

Next, as a second processing step, as illustrated in FIG. 6, a hole portion 203 is formed by cutting the thinned portion 201. At this time, as described above, since the thinned portion 201 is austenitized across all the layers thereof in the thickness direction, the ferrite phase is not exposed in the hole portion 203.

Figure 7:
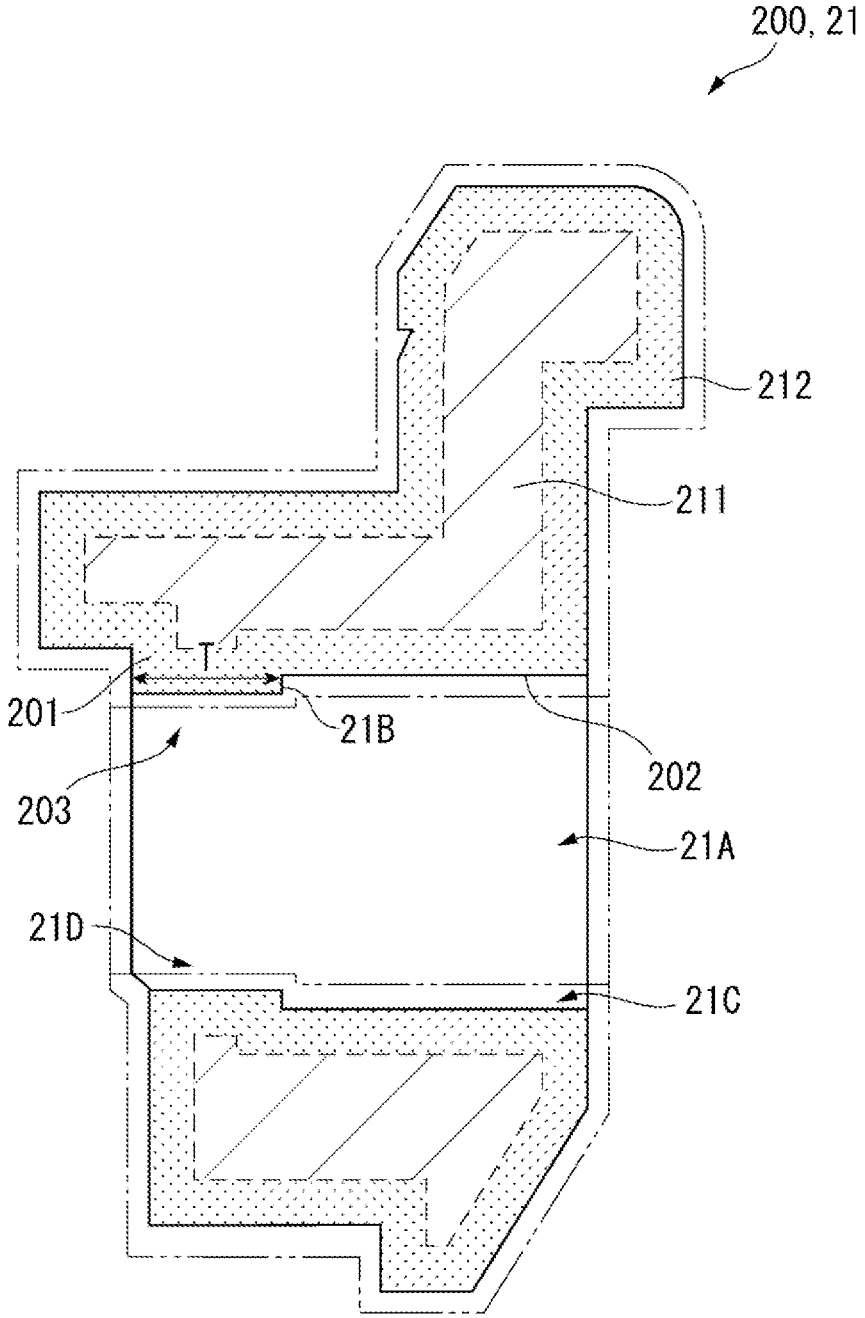
FIG. 7 is a schematic view illustrating the manufacturing process of the case main body.

Next, as illustrated in FIG. 7, the surface layer 212 formed as a result of the nitrogen absorption treatment is cut. In this embodiment, the surface layer 212 is cut so as to have a predetermined thickness from the outer surface of the base material 200 across the entire outer surface of the base material 200. As a result, in the heat treatment step described above, even if a deposit such as chromium nitride is deposited on the outer surface of the surface layer 212, the deposit can be removed, and the shape as the case main body 21 can be properly formed. In other words, the second processing step is a so-called main processing step in which the shape of the case main body 21 is properly formed.

In this way, in this embodiment, the through hole 21A is formed by providing the recessed portion 202 and the hole portion 203. Then, a portion corresponding to the recessed portion 202 forms the large diameter portion 21C, a portion corresponding to the hole portion 203 forms the small diameter portion 21D, and the step 21B is formed between the recessed portion 202 and the hole portion 203.

Here, as described above, since the thinned portion 201 is formed so that the thickness T is 0.5 mm or greater, even when the hole portion 203 is formed, the mechanical strength required as a watch component can be secured also in the thinned portion 201.

Polishing Step

Finally, as a polishing step, the outer surface of the surface layer 212 is polished to form the case main body 21. In this embodiment, in the polishing step, the outer surface of the surface layer 212, which is exposed to an external space of the case main body 21, is polished. As a result, the outer surface of the surface layer 212 can be smoothed. Thus, wear resistance and corrosion resistance can be improved, and at the same time, design quality can be enhanced by improvement in the mirror finish of the outer surface.

The case main body 21 formed in this manner is austenitized entirely in a cross-sectional view, and includes the thinned portion 201 including the recessed portion 202 and the hole portion 203, and portions that are provided on either side of the thinned portion 201, each of which includes the base portion 211, the surface layer 212, and the mixed layer 213. Note that being austenitized entirely means that a region from the outer surface of the case main body 21, that is, the outer surface of the case main body 21 that is exposed to the external space, to the inner surface of the case main body 21, which has a front and back relationship with the outer surface of the case main body 21, is austenitized.

Further, in other words, in a cross-sectional view, the case main body 21 includes a first region and a second region each including the base portion 211, the surface layer 212, and the mixed layer 213, and, between the first region and the second region, the entirely austenitized thinned portion 201 including the recessed portion 202 and the hole portion 203. Then, the crown 26, a button, and the like are disposed in the thinned portion 201.

Actions and Effects of Embodiment

According to this embodiment as described above, the following advantageous effects can be obtained.

The method for manufacturing the case main body 21 according to this embodiment includes the first processing step for forming the thinned portion 201 by providing the step 21B in the base material 200 formed of the ferritic stainless steel, the heat treatment step for performing the nitrogen absorption treatment on the base material 200 and forming the surface layer 212 on the outer surface side of the base portion 211, and the second processing step for providing the hole portion 203 in the thinned portion 201.

As a result, the surface layer 212 formed by the austenitized phase can be provided also in the portion corresponding to the hole portion 203, and it is thus possible to prevent the ferrite phase from being exposed in the through hole 21A and to prevent a deterioration in the corrosion resistance.

Further, in this embodiment, when forming the hole portion 203 in the second processing step, only the austenitized phase is cut. Thus, for example, in contrast to a case in which the hole portion is provided by cutting both the austenitized phase and the ferrite phase, where the cutting needs to be performed in accordance with the phases having different characteristics, in this embodiment, since it is sufficient that the cutting be performed only in accordance with the austenitized phase, the cutting can be more easily performed.

In this embodiment, the thinned portion 201 has a thickness that is smaller than the thickness of the portions other than the thinned portion 201, and the thinned portion 201 is austenitized across all the layers thereof in the thickness direction.

As a result, a time required for the heat treatment step for austenitizing the portion corresponding to the thinned portion 201 across all the layers thereof in the thickness direction can be shortened. Further, even if the portion corresponding to the thinned portion 201 is austenitized across all the layers thereof in the thickness direction, since the ferrite phase can remain in the portions other than the thinned portion 201, an anti-magnetic performance required for the case main body 21 can be secured.

In this embodiment, the thickness T of the thinned portion 201 is from 0.5 mm to 3.0 mm, and preferably from 0.5 mm to 2.0 mm.

As a result, the watch 1 can be made thinner while ensuring the mechanical strength of the thinned portion 201, and it is possible to prevent the time period required for the heat treatment step from being prolonged.

In this embodiment, in the second processing step, the surface layer 212 is cut so as to have the predetermined thickness from the outer surface of the base material 200 across the entire outer surface of the base material 200 on which the nitrogen absorption treatment has been performed.

In the heat treatment step, for example, even if the deposit such as the chromium nitride is deposited on the outer surface of the surface layer 212, since the deposit can be removed, it is possible to prevent the hardness, corrosion resistance, and the like from deteriorating due to the deposit.

Further, since the outer surface of the surface layer 212 is cut after the heat treatment step, even if the base material 200 is thermally deformed in the heat treatment step, the deformation can be corrected in the second processing step. Thus, compared to a case in which the base material is machined and then heat treated to form a watch component such as the case main body, dimensional accuracy as a watch component can be increased.

In this embodiment, after the second processing step, the polishing step is performed in which the outer surface of the case main body 21 is polished.

As a result, the wear resistance and corrosion resistance can be improved, and at the same time, the design quality can be enhanced.

In this embodiment, the base portion 211 contains, in mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with the remaining portion including Fe and the unavoidable impurities.

As a result, in the nitrogen absorption treatment, the transfer velocity of nitrogen to the ferrite phase and the diffusion velocity of nitrogen in the ferrite phase can be increased.

In this embodiment, in the heat treatment step, the nitrogen absorption treatment is performed on the base material 200 so that the nitrogen content of the surface layer 212 is from 1.0 to 1.6% in mass %.

As a result, the corrosion resistance in the surface layer 212 can be improved.

Modified Examples

Note that the present disclosure is not limited to the embodiment described above, and variations, modifications, and the like within the scope in which the object of the present disclosure can be achieved are included in the present disclosure.

In the embodiment described above, in the first processing step, the recessed portion 202 is formed by cutting the base material 200 from the outer surface side thereof, but the manufacturing process is not limited to this example.

Figure 8:
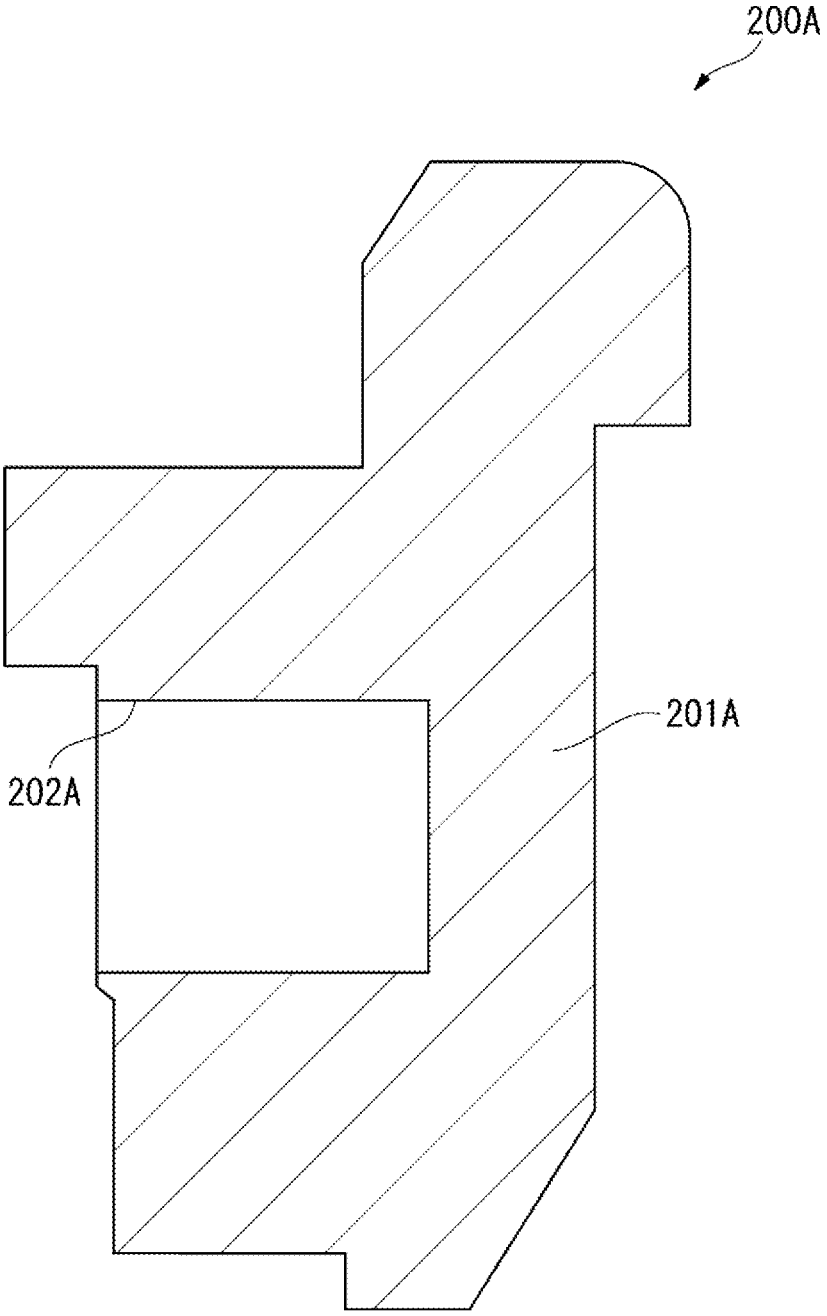
FIG. 8 is a schematic view illustrating a manufacturing process of the case main body according to a modified example.
Figure 9:
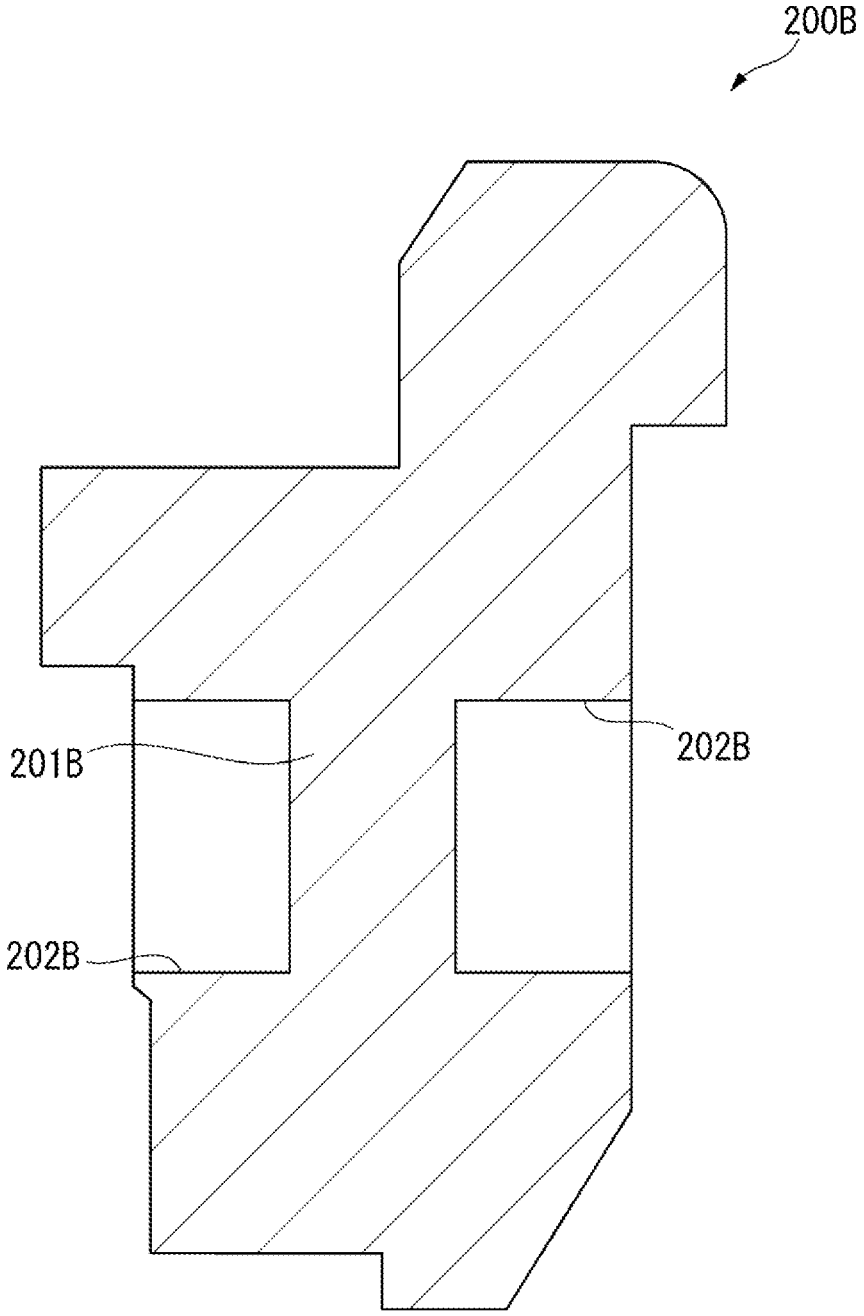
FIG. 9 is a schematic view illustrating a manufacturing process of the case main body according to a modified example.

FIG. 8 and FIG. 9 are schematic views each illustrating a manufacturing process of the case main body of a modified example.

As illustrated in FIG. 8, a thinned portion 201A may be formed on an outer surface side of a base material 200A by providing a recessed portion 202A formed by cutting an inner surface side of the base material 200A, that is, a side of the base material 200A that is not exposed when assembled as the watch 1.

Further, as illustrated in FIG. 9, a thinned portion 201B may be formed by providing recessed portions 202B formed by cutting both an outer surface side and an inner surface side of a base material 200B.

In the embodiment described above, the winding stem pipe 25 is fitted into and fixed to the through hole 21A, which is configured by the recessed portion 202 and the hole portion 203, but the configuration is not limited to this example.

Figure 10:
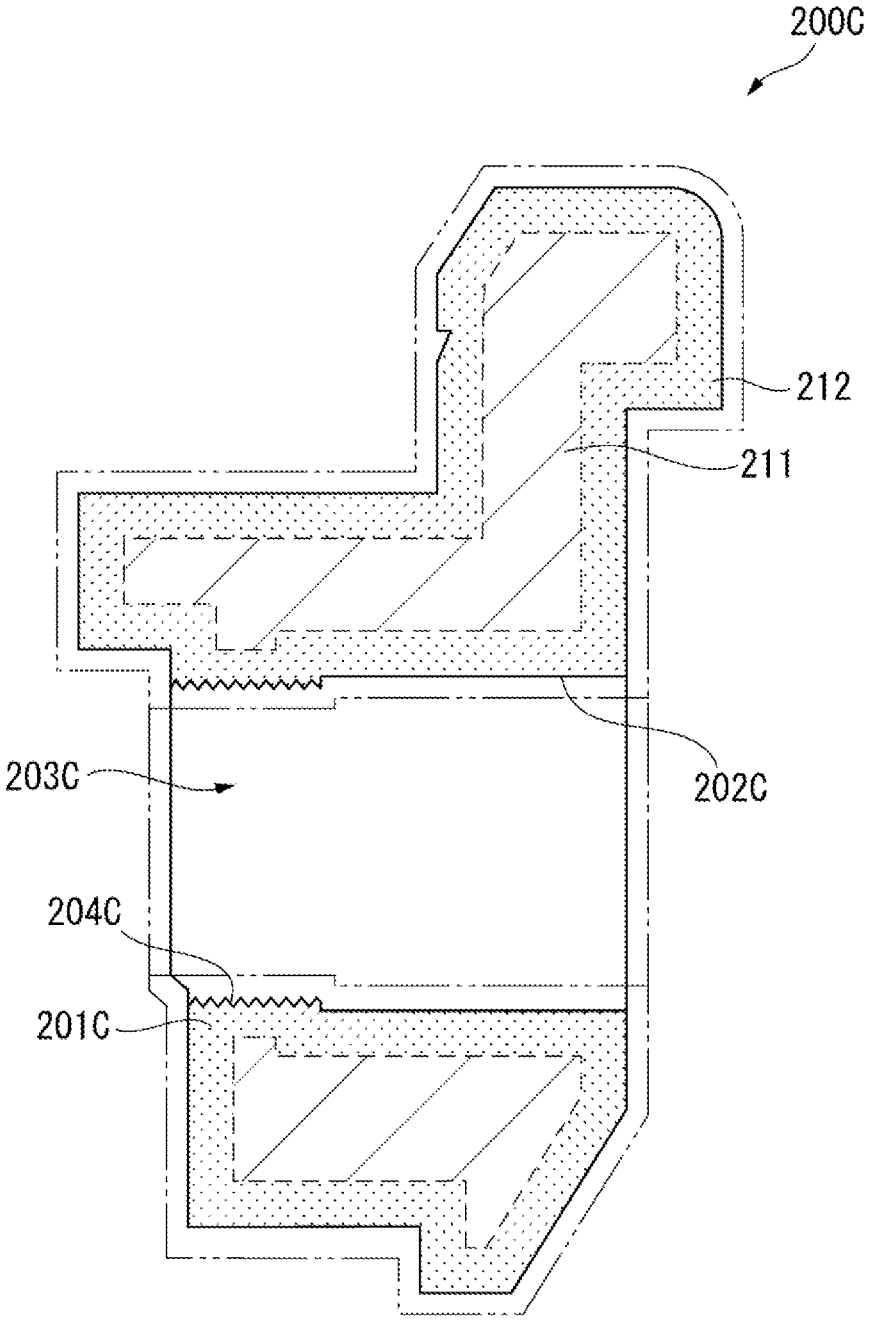
FIG. 10 is a schematic view illustrating a manufacturing process of the case main body according to a modified example.

FIG. 10 is a schematic view illustrating a manufacturing process of the case main body of a modified example. As illustrated in FIG. 10, a base material 200C is cut to form a recessed portion 202C and a hole portion 203C. Then, a third processing step may be provided in which a portion corresponding to the hole portion 203C, that is, an inner surface side of a thinned portion 201C, is threaded to form a threaded portion 204C. In this case, a threaded portion is also formed in the winding stem pipe, and a configuration is obtained in which the winding stem pipe is screwed into and fixed to the through hole.

Further, in the embodiment described above, the winding stem pipe 25 is fixed to the through hole 21A, but the configuration is not limited to this example. For example, a button portion or the like may be fixed to the through hole.

In the embodiment described above, the watch component of the present disclosure is configured as the case main body 21, but the configuration is not limited to this example. For example, the watch component of the present disclosure may be configured as one of a band piece, an end-piece, a clasp, a bezel, a case back, a crown, a button, and an outer case body. Further, the watch may include a plurality of the watch components as described above.

In the embodiment described above, in the first processing step, the thinned portion 201 is formed by providing the recessed portion 202 by cutting, but the manufacturing process is not limited to this example. For example, the thinned portion 201 may be formed by forging. In other words, in the first processing step, either the cutting or the forging may be performed.

In the embodiment described above, the case main body 21 includes the base portion 211 formed by the ferrite phase, the surface layer 212 formed by the austenitized phase, and the mixed layer 213 in which the ferrite phase and the austenitized phase are mixed, but the configuration is not limited to this example. For example, the case main body may be configured to include the surface layer 212, the mixed layer 213, the base portion 211, and further, a second mixed layer and a second surface layer provided on the opposite side of the base portion 211 from the mixed layer 213 and the surface layer 212. In other words, a configuration may be adopted in which a first mixed layer and a first surface layer are provided on the outer circumferential side of the case main body, the second mixed layer and the second surface layer are provided on the inner circumferential side of the case main body, and the base portion is provided between the first mixed layer and the second mixed layer.

In the embodiment described above, the polishing step is performed in which the outer surface of the surface layer 212 is polished, but the manufacturing process is not limited to this example. For example, a groove forming step may be performed to form a groove in the outer surface of the surface layer. Furthermore, a decorating step such as plating processing on the outer surface may be added. By adopting such a configuration, the design quality can be further improved.

In the embodiment described above, in the first processing step, the base material 200 is cut so that the thickness T of the thinned portion 201 is from 0.5 mm to 3.0 mm, and, in the heat treatment step, the base material 200 is subjected to the nitrogen absorption treatment so that the thinned portion 201 is austenitized across all the layers thereof in the thickness direction. However, the manufacturing process is not limited to this example. For example, when the heat treatment step is performed to form the surface layer having a thickness required as a watch, cutting may be performed in the first processing step so that the thinned portion is austenitized across all the layers thereof in the thickness direction.

In the embodiment described above, in the second processing step, the hole portion 203 is formed so that the step 21B is formed, namely, the hole portion 203 is formed so as to have a diameter smaller than that of the recessed portion 202, but the configuration is not limited to this example. For example, in the second processing step, the hole portion may be formed so as to have the same diameter as that of the recessed portion.

In the embodiment described above, the method for manufacturing the case main body 21 as a watch component is illustrated, but the manufacturing method is not limited to this example. For example, the manufacturing method according to the present disclosure may be applied to a case of an electronic device other than the watch, that is, an electronic device component such as a housing.

Summary of Present Disclosure

A method for manufacturing a watch component according to the present disclosure is a method for manufacturing a watch component that is configured by an austenitized ferritic stainless steel including a base portion formed by a ferrite phase and a surface layer formed by an austenitized phase obtained by austenitizing the ferrite phase, and the method includes a first processing step for forming a thinned portion by providing a step in a base material formed by a ferritic stainless steel, a heat treatment step for performing nitrogen absorption treatment on the base material to form the surface layer on an outer surface side of the base portion, and a second processing step for providing a hole portion in the thinned portion.

As a result, the surface layer formed by the austenitized phase can be provided also in a portion corresponding to the hole portion, and it is thus possible to prevent the ferrite phase from being exposed in the hole portion, and it is thus possible to prevent the ferrite phase from being exposed in the hole portion and to prevent a deterioration in corrosion resistance.

In the method for manufacturing the watch component according to the present disclosure, a thickness of the thinned portion may be smaller than that of a portion other than the thinned portion, and the thinned portion may be austenitized across all layers thereof in a thickness direction.

As a result, since the thickness of the thinned portion is smaller than that of the portion other than the thinned portion, a time required for the heat treatment step for austenitizing the thinned portion across all the layers thereof in the thickness direction can be shortened. Further, even if the thinned portion is austenitized across all the layers thereof in the thickness direction, since the ferrite phase can remain in the portion other than the thinned portion, an anti-magnetic performance required as a watch component can be secured.

In the method for manufacturing the watch component according to the present disclosure, one of cutting and forging may be performed in the first processing step.

In the method for manufacturing the watch component according to the present disclosure, a thickness of the thinned portion may be from 0.5 mm to 3.0 mm.

As a result, a watch can be made thinner while ensuring the mechanical strength of the thinned portion, and it is possible to prevent the time period required for the heat treatment step from being prolonged.

In the method for manufacturing the watch component according to the present disclosure, a thickness of the thinned portion may be from 0.5 mm to 2.0 mm.

As a result, the watch can be made thinner while ensuring the mechanical strength of the thinned portion, and it is possible to prevent the time period required for the heat treatment step from being prolonged.

In the method for manufacturing the watch component according to the present disclosure, in the second processing step, the surface layer may be cut, across the entire outer surface of the base material on which the nitrogen absorption treatment was performed, to have a predetermined thickness from an outer surface thereof.

As a result, in the heat treatment step, for example, even if a deposit such as chromium nitride is deposited on the outer surface of the surface layer, since the deposit can be removed, it is possible to prevent the hardness, corrosion resistance, and the like from deteriorating due to the deposit.

Further, since the outer surface of the surface layer is cut after the heat treatment step, even if the base material is thermally deformed in the heat treatment step, the deformation can be corrected in the second processing step. Thus, compared to a case in which the base material is machined and then heat treated to form a watch component such as the case main body, dimensional accuracy as a watch component can be increased.

The method for manufacturing the watch component according to the present disclosure may include a polishing step, performed after the second processing step, for polishing an outer surface of the watch component.

As a result, wear resistance and corrosion resistance can be improved, and at the same time, design quality can be enhanced.

The method for manufacturing the watch component according to the present disclosure may include a third processing step, performed after the second processing step, for threading a portion corresponding to the hole portion to form a threaded portion.

As a result, the surface layer can be provided in the threaded portion that has been threaded. Thus, it is possible to prevent the ferrite phase from being exposed in the threaded portion and to prevent a deterioration in the corrosion resistance.

In the method for manufacturing the watch component according to the present disclosure, the base portion may contain, in mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a remaining portion including Fe and unavoidable impurities.

As a result, in the nitrogen absorption treatment, a transfer velocity of nitrogen to the ferrite phase and a diffusion velocity of nitrogen in the ferrite phase can be increased.

In the method for manufacturing the watch component according to the present disclosure, in the heat treatment step, the nitrogen absorption treatment may be performed on the base material so that a nitrogen content of the surface layer is from 1.0 to 1.6% in mass %.

As a result, the corrosion resistance in the surface layer can be improved.

In the method for manufacturing the watch component according to the present disclosure, the watch component may be at least one of a case, a band piece, an end-piece, a clasp, a bezel, a case back, a crown, a button, and an outer case body.

What is claimed is:

1. A method for manufacturing a watch component including an austenitized ferritic stainless steel including a base portion formed by a ferrite phase and a surface layer formed by an austenitized phase obtained by austenitizing the ferrite phase, the method comprising:

a first processing step for forming a thinned portion by providing a step in a base material formed by a ferritic stainless steel;

a heat treatment step for performing nitrogen absorption treatment on the base material including the thinned portion to form the surface layer on an outer surface side of the base portion, an entirety of the thinned portion after the heat treatment step being formed of the austenitized phase; and a second processing step for providing a hole portion in the thinned portion that is entirely austenitized.

2. The method for manufacturing the watch component according to claim 1, wherein a thickness of the thinned portion is smaller than that of a portion other than the thinned portion, and the thinned portion is austenitized across all layers thereof in a thickness direction.

3. The method for manufacturing the watch component according to claim 1, wherein one of cutting and forging is performed in the first processing step.

4. The method for manufacturing the watch component according to claim 2, wherein one of cutting and forging is performed in the first processing step.

5. The method for manufacturing the watch component according to claim 1, wherein a thickness of the thinned portion is from 0.5 mm to 3.0 mm.

6. The method for manufacturing the watch component according to claim 2, wherein the thickness of the thinned portion is from 0.5 mm to 3.0 mm.

7. The method for manufacturing the watch component according to claim 3, wherein a thickness of the thinned portion is from 0.5 mm to 3.0 mm.

8. The method for manufacturing the watch component according to claim 1, wherein a thickness of the thinned portion is from 0.5 mm to 2.0 mm.

9. The method for manufacturing the watch component according to claim 1, wherein in the second processing step, the surface layer is cut across the entire outer surface of the base material on which the nitrogen absorption treatment was performed, the surface layer having a predetermined thickness from an outer surface of the base material.

10. The method for manufacturing the watch component according to claim 2, wherein in the second processing step, the surface layer is cut across the entire outer surface of the base material on which the nitrogen absorption treatment was performed, the surface layer having a predetermined thickness from an outer surface of the base material.

11. The method for manufacturing the watch component according to claim 9, comprising:

a polishing step, performed after the second processing step, for polishing an outer surface of the watch component.

12. The method for manufacturing the watch component according to claim 1, comprising:

a third processing step, performed after the second processing step, for threading a portion corresponding to the hole portion to form a threaded portion.

13. The method for manufacturing the watch component according to claim 4, comprising:

a third processing step, performed after the second processing step, for threading a portion corresponding to the hole portion to form a threaded portion.

14. The method for manufacturing the watch component according to claim 7, comprising:

a third processing step, performed after the second processing step, for threading a portion corresponding to the hole portion to form a threaded portion.

15. The method for manufacturing the watch component according to claim 1, wherein the base portion contains, in mass %, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a remaining portion including Fe and unavoidable impurities.

16. The method for manufacturing the watch component according to claim 1, wherein in the heat treatment step, the nitrogen absorption treatment is performed on the base material so that a nitrogen content of the surface layer is from 1.0 to 1.6% in mass %.

17. The method for manufacturing the watch component according to claim 2, wherein in the heat treatment step, the nitrogen absorption treatment is performed on the base material so that a nitrogen content of the surface layer is from 1.0 to 1.6% in mass %.

18. The method for manufacturing the watch component according to claim 6, wherein in the heat treatment step, the nitrogen absorption treatment is performed on the base material so that a nitrogen content of the surface layer is from 1.0 to 1.6% in mass %.

19. The method for manufacturing the watch component according to claim 1, wherein the watch component is at least one of a case, a band piece, an end-piece, a clasp, a bezel, a case back, a crown, a button, and an outer case body.

20. The method for manufacturing the watch component according to claim 2, wherein the watch component is at least one of a case, a band piece, an end-piece, a clasp, a bezel, a case back, a crown, a button, and an outer case body.

* * * * *